United States Patent [19]

Coralli et al.

[11] 4,229,955

[45] Oct. 28, 1980

[54] LOCK FOR ROLLER SHUTTERS

[75] Inventors: Giorgio V. Coralli; Alessandro Brunelli, both of Bologna, Italy

[73] Assignee: Viro Innocenti S.p.A., Zola Predosa, Italy

[21] Appl. No.: 946,693

[22] Filed: Sep. 28, 1978

[30] Foreign Application Priority Data

Oct. 3, 1977 [IT] Italy ..... 15219/77[U]

[51] Int. Cl.[3] ..... E05B 67/36

[52] U.S. Cl. ..... 70/32; 70/52

[58] Field of Search ..... 70/32, 33, 34, 38 R, 70/38 A, 38 B, 38 C, 52, 23, 54–56

[56] References Cited

U.S. PATENT DOCUMENTS

| | | | |
|---|---|---|---|
| 1,546,021 | 7/1925 | Parmele | 70/32 |
| 2,660,872 | 12/1953 | Beach | 70/32 |
| 3,263,463 | 8/1966 | Duval | 70/455 |
| 3,581,530 | 6/1971 | Respadori | 70/38 R |
| 3,996,774 | 12/1976 | Best | 70/34 |

*Primary Examiner*—Robert L. Wolfe

*Attorney, Agent, or Firm*—Jordan and Hamburg

[57] ABSTRACT

The lock for roller shutters comprises a hood-shaped body secured to the roller shutter and presenting a cavity directed downwardly, in such a manner that, when the roller shutter is lowered to its closure condition, the body encloses within its cavity an anchoring ring fastened to the threshold of the door. A straight bolt is mounted axially slidable in the lock body, so as to be capable of engaging the anchoring ring. A cylinder lock mechanism, also housed in the body, ensures the locking of the slidable bolt in its closure position.

2 Claims, 5 Drawing Figures

LOCK FOR ROLLER SHUTTERS

BACKGROUND OF THE INVENTION (1) Field of the Invention.

The present invention relates to locks, and particularly to locks adapted to be secured to the outer side of a roller shutter, in correspondence of its bottom or threshold extremity. The said locks present a bolt or shackle member which, in the lowered condition of the roller shutter, engages an anchoring ring secured to the threshold of the door or opening to be closed by the roller shutter.

(2) Statement of the Prior Art Known.

The following prior art is known to the applicants:

U.S. Pat. No. 3,581,530 (RASPADORI): the whole document.

U.S. Pat. No. 3,981,168 (VANELLI CORALLI et al.): the whole document.

U.S. patent application No. 886,502 filed Mar. 14, 1978, in the name of the same applicants as in the present case, having for title "Protected Padlock".

SUMMARY OF THE INVENTION

The invention relates to an improvement in the locks of the type referred to, in which the lock to be secured to the roller shutter presents a hood-shaped body having a cavity directed downwardly, in such a manner that, whenever the shutter is lowered to close the door or opening, the hood shaped body encloses, within its cavity, the anchoring ring secured to the threshold. A straight shackle or bolt is slidably mounted on the body, in such a manner as to engage, upon manual actuation, the said anchoring ring, and locking means are provided in order to lock the bolt in its closure condition.

The shape and construction of the hood-shaped body are such as to reduce in a remarkable manner the possibilities, by thieves, of getting hold of the body and ripping it off. Moreover, the components of the mechanism of the lock, such as bolt, locking means for the bolt, and anchoring ring, are protected from the external agents such as rain and dust.

The above and other features of the invention, and the advantages deriving therefrom, will appear evident from the following detailed description of a preferred embodiment, made with reference to the attached drawings.

DESCRIPTION OF THE PREFERRED EMBODIMENT

Figure 5:
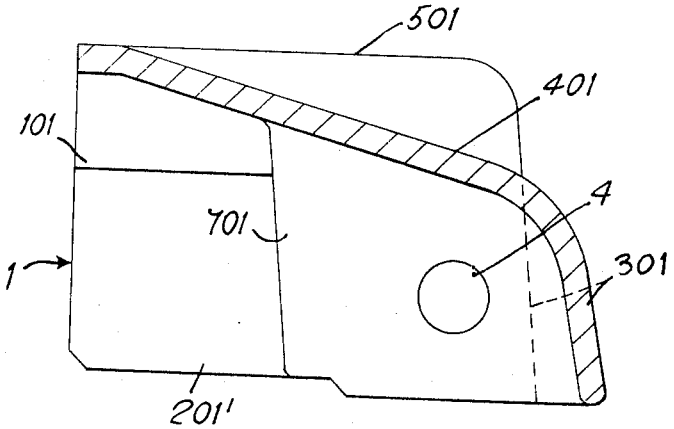
FIG. 5 is a vertical section of the lock, taken along line V—V of FIG. 3.
Figure 2:
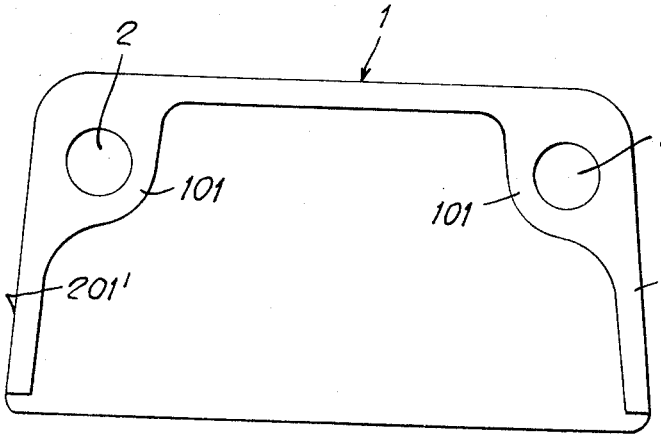
FIG. 2 is a side elevation view from the rear of the lock of FIG. 1, i.e. a view in the direction of arrows II—II of FIG. 1.

With reference to the Figures, the lock comprises a body 1 made of steel having the shape of a hood which presents in cross section an inverted U shape and which is provided at its rear (see FIGS. 2 and 5) with two thickened portions 101 in which there are obtained threaded bores 2 serving for fastening the body 1 to the outer side of the roller shutter, in correspondence of its bottom or threshold extremity. The body 1 is fastened to the roller shutter by means of screws, in such a manner that the cavity of the hood is directed downwardly.

The side faces 201 and 201' of the body 1 are suitably shaped so as to converge upwardly and frontally (i.e. in a direction away from the outer side of the roller shutter) in order to render more difficult the attempt of gripping and getting hold of the body 1 with the intention of ripping it off the shutter.

In longitudinal section (as it appears from FIG. 1) the body 1 presents an inverted L shape. The front face 301 of body 1 presents a composite contour, as it clearly appears from FIG. 1, with a portion 401 which projects forwards with respect to a portion 501. The upper face of body 1 also presents a composite contour, as it appears from FIGS. 1 and 5, having a surface 401 inclined downwardly and another surface 501 which is substantially horizontal. In the corner zones defined by the side faces 201, 201' and the front face 301 there are obtained, at the interior of body 1, thickened portions 601, 701 defining between them a recess 3 which is intended to accomodate the anchoring ring A (i.e. the ring secured to the threshold) whenever the shutter is lowered to its closed condition.

On the side face 201 of body 1, in correspondence of the thickened portion 601, there is obtained the transversal bore 4, which continues also in the other thickened portion 701 where it terminates as a dead end bore. Inside this bore there is slidably housed the straight bolt 5 presenting at one end an enlarged head 105 which abuts against the face 201 when the lock is in its closed condition, and an annular groove 205 provided in correspondence with the other end and intended to cooperate with the cylinder lock mechanism housed in the thickened portion 701. As it appears from FIGS. 3 and 4 a cylindrical seat 6 is obtained vertically in the thickened portion 701 in such a manner that the bore 4 comes to be secant to the said cylindrical seat 6. Inside the cylindrical seat 6 there is fitted the cylinder 7 of the cylinder lock mechanism. The said cylinder 7 is secured at the interior of the cylindrical seat 6 by means of a locking pin 8. At the interior of cylinder 7 there is rotatably mounted, in a known manner, the rotatable plug 9, which can be rotated upon insertion of the appropriate coded key inserted in the keyhole through a bore 10 obtained in the upper face 501. The cylinder lock mechanism 7, 9, of known type, presents a great number of pin tumblers 11, and, for the protection of the keyhole extremity of the rotatable plug 9, it presents also a small disc 12 (with a slot for the insertion of the key) made of hardened steel.

Figure 1:
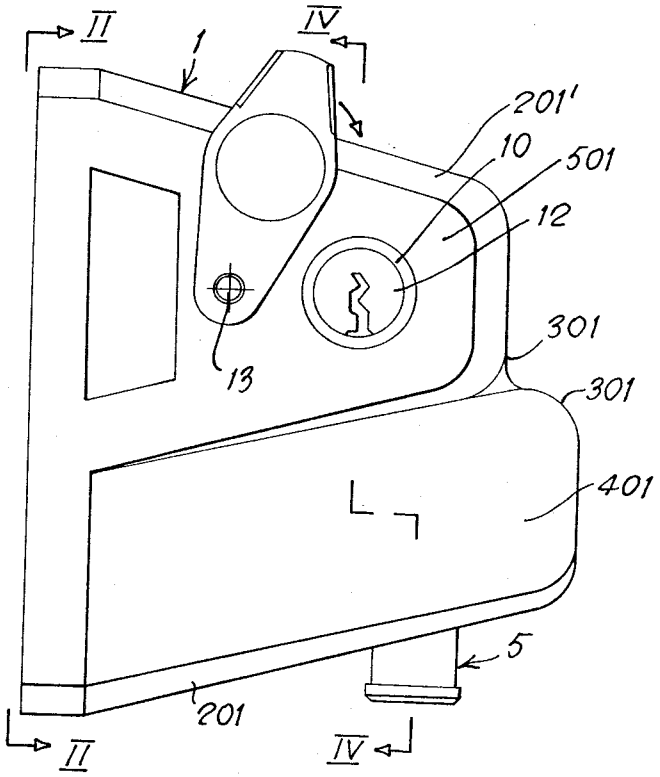
FIG. 1 is a top view of a lock according to the invention.

As it appears from FIG. 1, on the upper face 501 of body 1 there is hinged at 13 a small protection cover 14 which can be rotated to close the bore 10 and which serves to protect the keyhole of the cylinder lock mechanism to avoid the infiltration of water, dust and extraneous particles in general. The cylinder 7 of the cylinder lock mechanism presents a transversal recess 107 for permitting the free movement of the straight bolt 5 and, in correspondence of said recess, the rotatable plug 9 presents a flattened portion 109.

Figure 3:
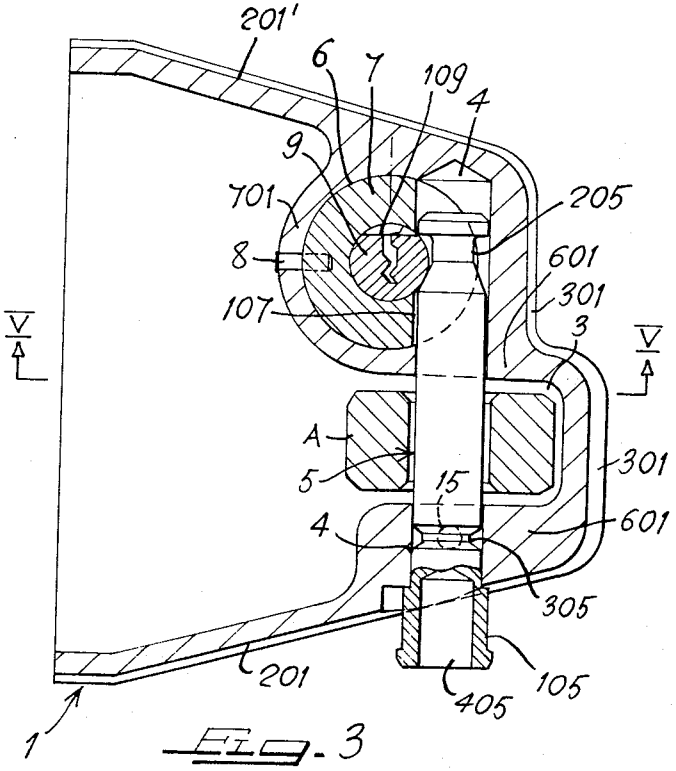
FIG. 3 is an horizontal section through the lock according to the invention.

Whenever the bolt 5 is completely inserted into the bores 4, and the rotatable plug 9 has been rotated, by the key, to the position shown in FIG. 3 (at which position the key can be extracted from the keyhole) then the lock is in its closure position, since the annular groove 205 of the bolt 5 is engaged by the cylindrical surface of the plug 9 which projects at the interior of dead end bore 4, so that the said bolt 5 is locked against axial displacement and it engages the anchoring ring A (see also FIG. 4) which is secured to the threshold of the door to be closed by the roller shutter. In order to open the lock, it will be necessary to introduce the key, and rotate the plug 9 so as to bring its flattened portion 109 in alignment with the inner wall of bore 4. In this manner it will be possible to extract the bolt 5, thus disengaging same from the anchoring ring A.

Figure 4:
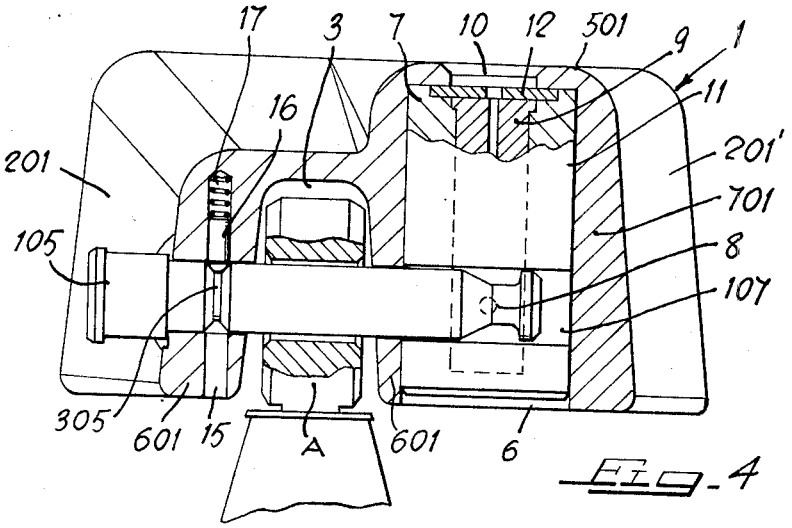
FIG. 4 is a vertical section of the lock, taken along line IV—IV of FIG. 1.

As it appears from FIGS. 3 and 4, a bore 15 is obtained in the thickened portion 601, for housing a detent pin 16 which is urged towards the exterior by the spring 17. The said pin cooperates, in the closed condition of the lock, with an annular groove 305 provided in correspondence of the free end of the bolt 5, so as to hold steady the bolt 5 in its inserted or closure position, thus contributing to establish the correct position of engagement of the annular groove 205 of the said bolt 5 with the rotatable plug 9. Whenever the bolt 5 is extracted to the open position of the lock, the pin 16 engages the annular groove 205 of bolt 5, and avoids the complete sliding out of bolt 5 from the body 1.

As it appears from FIG. 3, the free end of the bolt 5, i.e. the end which projects out of the lock body 1, presents an axial weakening recess 405, so that the said end breaks easily, if it is bent or compressed under the action of tools used by thieves, in the attempt of extracting the bolt from the lock.

It is understood that to the lock as described there can be brought numerous changes, in particular from the constructive viewpoint, the whole without departing from the leading principle of the invention, as described above and claimed hereafter.

We claim:

1. In a roller shutter lock of a type including a body, a bolt slidably situated in the body for engagement with an anchoring ring secured to a threshold, and a key cylinder for locking said bolt, the improvement comprising a hood-shaped body having a rear flat surface attached to an outer side of the roller shutter, two side surfaces which converge upwardly and outwardly from the outer side of the roller shutter, an upper surface having at least a portion inclined downwardly, and a flat bottom surface, said body including a cavity extending from the bottom surface thereof to receive the anchoring ring therein when the shutter is closed, said bolt extending laterally across the cavity and said key cylinder being situated vertically to lock or unlock the bolt directly.

2. A lock for roller shutter according to claim 1, in which said rear flat surface includes threaded bores for attachment of the body to the roller shutter by means of bolts.

* * * * *